US011383176B1

(12) United States Patent
Mathis

(10) Patent No.: US 11,383,176 B1
(45) Date of Patent: Jul. 12, 2022

(54) SYSTEM FOR REMOVABLY INTERLOCKING AT LEAST TWO INDEPENDENT FIGURINES

(71) Applicant: Cheryl A. Mathis, Waycross, GA (US)

(72) Inventor: Cheryl A. Mathis, Waycross, GA (US)

( * ) Notice: Subject to any disclaimer, the term of this patent is extended or adjusted under 35 U.S.C. 154(b) by 35 days.

(21) Appl. No.: 17/126,158

(22) Filed: Dec. 18, 2020

(51) Int. Cl.
*A63H 3/16* (2006.01)
*A63H 9/00* (2006.01)

(52) U.S. Cl.
CPC ..... *A63H 3/16* (2013.01); *A63H 9/00* (2013.01)

(58) Field of Classification Search
CPC ..... A63H 3/00; A63H 3/16; A63H 9/00
See application file for complete search history.

(56) References Cited

U.S. PATENT DOCUMENTS 1,227,129 A * 5/1917 Frueh ..... A63H 3/16 43/2
2,036,302 A * 4/1936 Leon ..... A63H 3/16 446/124
2,725,234 A * 11/1955 Coble ..... A63F 9/1288 273/157 R
2,760,303 A * 8/1956 Del Mas ..... A63H 3/16 40/418
3,800,442 A 4/1974 Petrocelli
5,700,177 A 12/1997 Lemelson
5,727,984 A * 3/1998 Lin ..... A63H 33/005 473/576
5,810,357 A * 9/1998 Brink ..... A63F 9/1288 273/156
6,276,684 B1 * 8/2001 Hershkovits ..... A63F 9/1288 273/156
D480,116 S * 9/2003 Collins ..... A63H 3/16 D21/479
7,140,945 B2 * 11/2006 Dinhofer ..... A63H 13/16 446/309

* cited by examiner

*Primary Examiner* — John A Ricci
(74) *Attorney, Agent, or Firm* — Sanchelima & Associates, P.A.; Christian Sanchelima; Jesus Sanchelima

(57) ABSTRACT

A system for removably interlocking at least two independent figurines is composed of stacked or continuous, circular ovoid members having space in-between. Each of the two independent figurines includes at least two crimped layers which serve as an interlocking mechanism. One figure is then inserted into and interfitted with the other figure to form a single unified structure. The crimped layers of each figurine are then removably interlocked to maintain the single unified structure. In one embodiment, the figurines may come in the form of a man and may have a predetermined color.

11 Claims, 7 Drawing Sheets

SYSTEM FOR REMOVABLY INTERLOCKING AT LEAST TWO INDEPENDENT FIGURINES

I. BACKGROUND OF THE INVENTION

1. Field of the Invention

The present invention relates to a system for interlocking figurines and, more particularly, to a system for removably interlocking figurines that includes one figure that is inserted and interfitted with another figurine using crimped layers to form a single unified structure.

2. Description of the Related Art

Several designs for figurines have been designed in the past. None of them, however, include a system for removably interlocking at least two independent figurines which are composed of stacked or continuous, circular ovoid members having space in-between. Each of the two independent figurines includes at least two crimped layers which serve as an interlocking mechanism. One figure is then inserted into and interfitted with the other figure to form a single unified structure. The crimped layers of each figurine are then removably interlocked to maintain the single unified structure. In one embodiment, the figurines may come in the form of a man and may have a predetermined color. It is known that figurines are often used for educational purposes. There is a need for a system that may be used as an educational tool used to demonstrate religious symbolism such as the representation of God and human being.

Applicant believes that a related reference corresponds to U.S. Pat. No. 3,800,442 issued for a sculpture device. Applicant believes that another related reference corresponds to U.S. Pat. No. 5,700,177 issued for a stacked component assembly toy. However, the cited references differ from the present invention because they fail to disclose the figurines composed of stacked circular or ovoid members with space in between. The figures are then inserted and interfitted with each other to form a single unified structure.

Other documents describing the closest subject matter provide for a number of more or less complicated features that fail to solve the problem in an efficient and economical way. None of these patents suggest the novel features of the present invention.

II. SUMMARY OF THE INVENTION

It is one of the objects of the present invention to provide a system for removably interlocking at least two independent figurines with crimping layers to allow the figurines to be easily interfitted with each other.

It is another object of this invention to provide a system for removably interlocking at least two independent figurines which spirals into an enclosure to allow a string or chain to be connected thereby allowing the figurines to be portable.

It is still another object of the present invention to provide a system for removably interlocking at least two independent figurines that is educational in teaching religious symbolism.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

III. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 9:
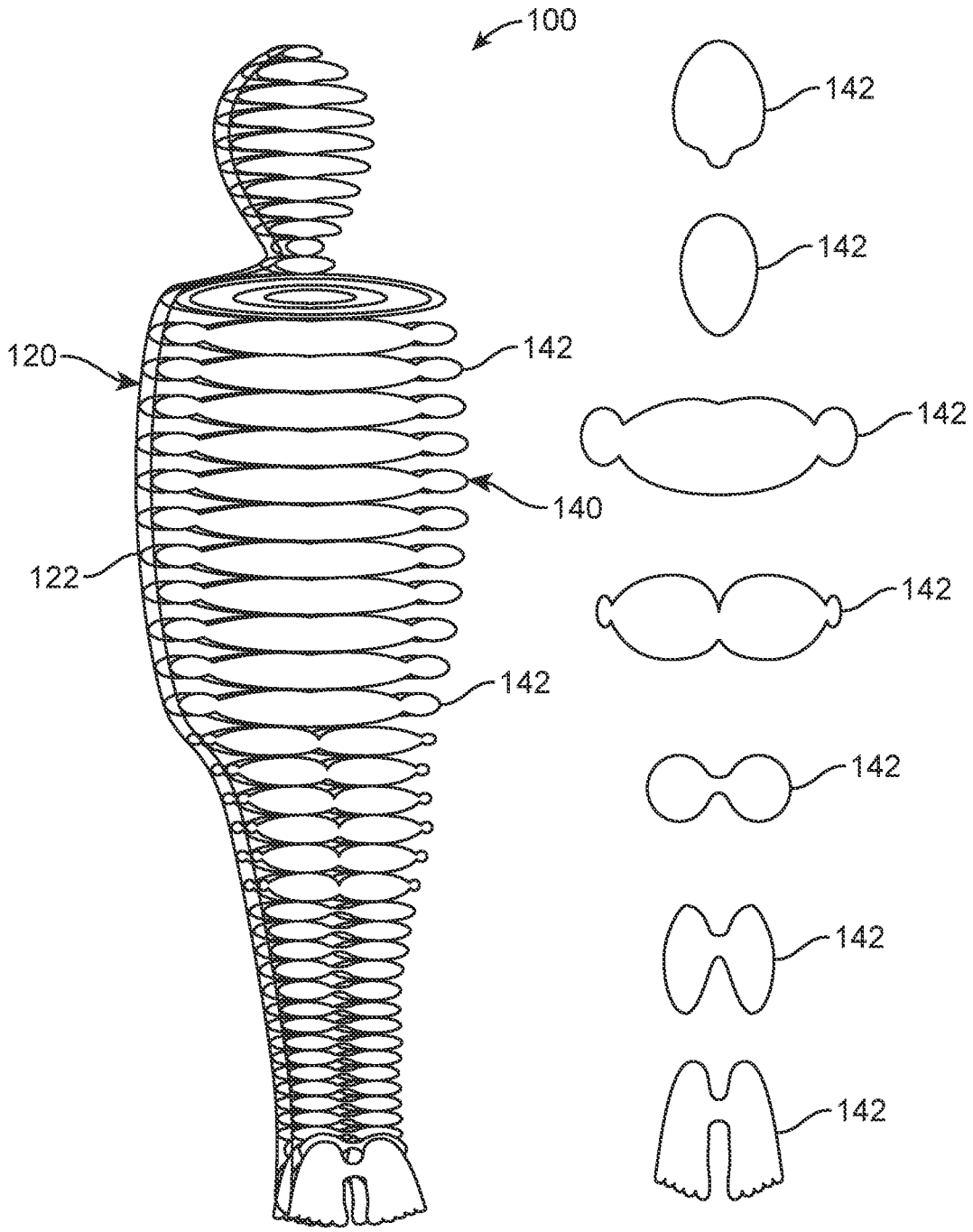

FIG. 9 shows an operational isometric view of system 100 including a support assembly 120 and an ovoid assembly 140 in accordance to an embodiment of the present invention.

IV. DETAILED DESCRIPTION OF THE EMBODIMENTS OF THE INVENTION

Referring now to the drawings, where the present invention is generally referred to with numeral 10, it can be observed a system for removably interlocking at least two independent figurines 10 which basically includes a figurine assembly 20 and a crimping assembly 40.

Figurine assembly 20 includes at least two figurine structures which include a first figurine coil 22 and a second figurine coil 24. In the present embodiment, each of the coils 22 and 24 may be provided as being made of a metal material such as stainless steel, aluminum, or other types of metals. Additionally, each of the coils 22 and 24 should be substantially flexible and not entirely rigid. If the coils 22 and 24 are provided as being made of a completely rigid material, they will be unable to easily lock and be removed from each other. As a result, a flexible configuration is preferred. Further, as observed in the drawings, each of the coils may be modeled after a humanoid figure. However, it should be understood that other variations of figurines may be implemented into the present system and the figurines 22 and 24 are not limited to being a humanoid figure. Other types of figures may include animals, objects, or other forms of religious symbolism and educational models. Each of the coils 22 and 24 should be provided as a continuous string of coil, that is each coil forms the figure as a continuous structure without any interruptions. The coils will include spacing in between that will aid in joining and mating each of the coils into a unified structure. Furthermore, the present embodiment may feature each of the coils 22 and 24 each being a different color. In one embodiment, the first figurine coil 22 is a left coil provided as being a silver color. Additionally, the second figurine coil 24 is a right coil being provided as a gold color. It should be understood that other colors may be used in different embodiments of the system.

Figure 8:
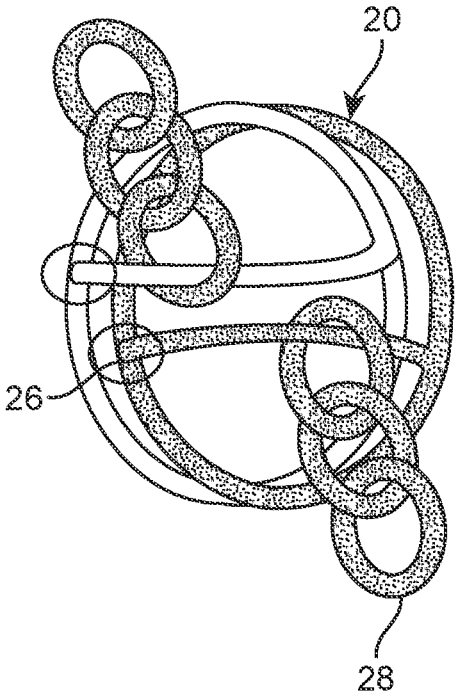
FIG. 8 shows a top view of figurine assembly 20 in a unified position and depicts a chain being received in the top of the unified structure.

Each of the first and second figurine coils 22 and 24 are configured to be joined and interfitted with other through crimping assembly 40 in order to form a single unified structure. When joined together, each man spirals into an enclosure 26 on the top of the head where a chain 28 or string may be connected. The structure of the enclosure 26 and the chain may be observed in FIG. 8 of the provided drawings. It can be seen that the enclosure includes receiving sections that receive the chain 28. In one embodiment, the flexible material of the top of the figurines 22 and 24 may be manipulated in order to overlap the coils and effectively lock them together to secure the chain 28 to the top enclosure 26. It should be understood that multiple variations of holder mechanisms may be attached to the figurine and it is not limited to only being a chain 28.

Figure 1:
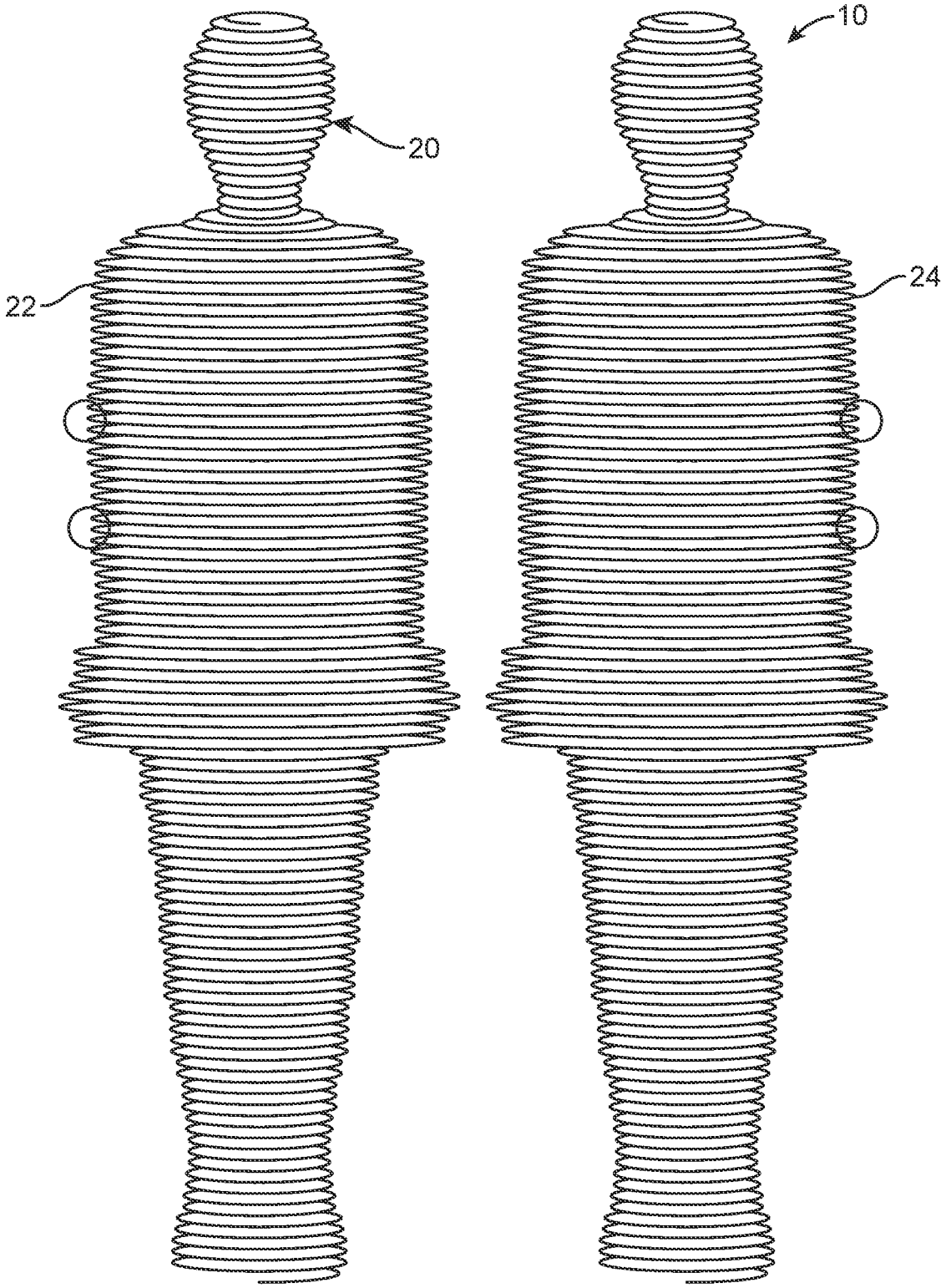
FIG. 1 represents an operational isometric view showing the figurines of figure assembly 20 being joined together in accordance to an embodiment of the present invention.
Figure 2:
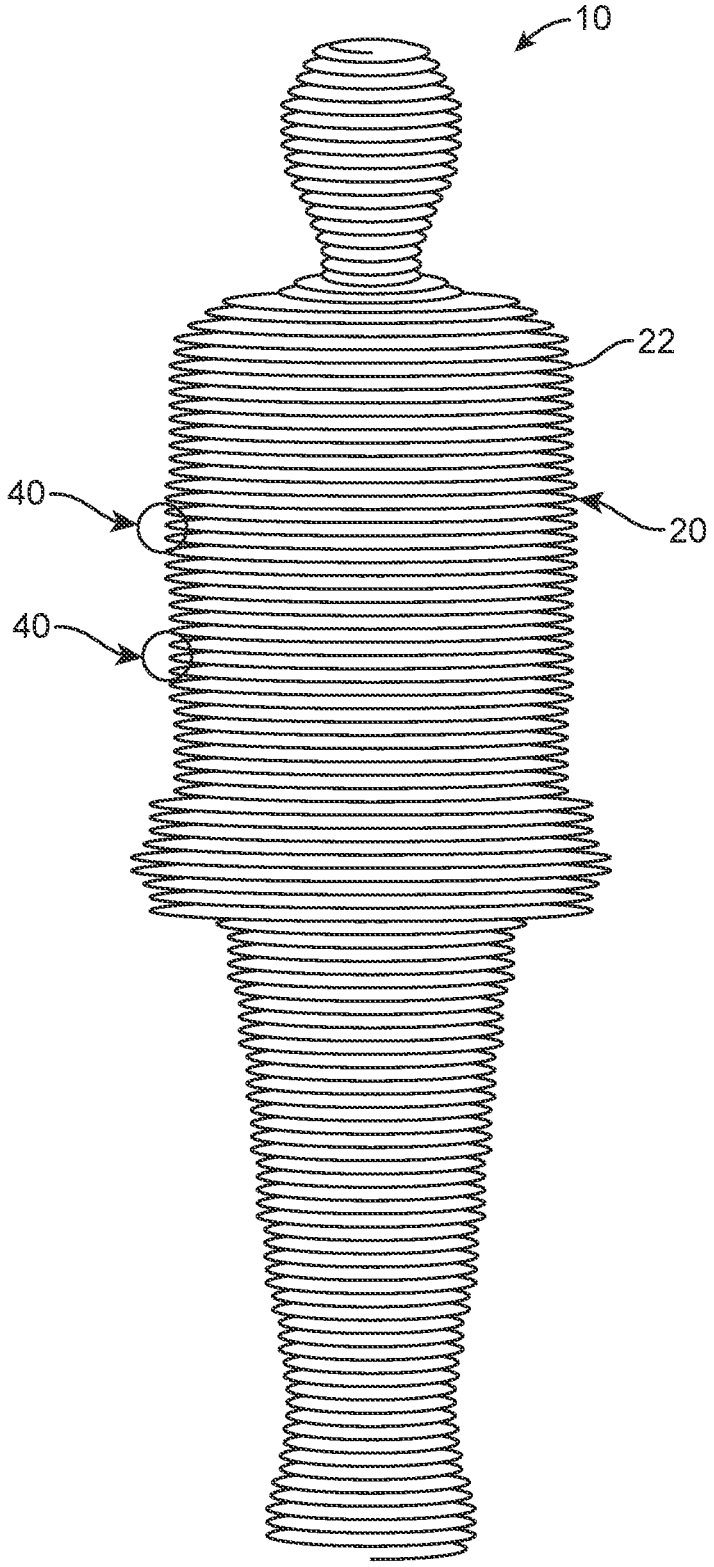
FIG. 2 shows an isometric view of a first figurine of figurine assembly 20 in the form of a humanoid figure in accordance to an embodiment of the present invention.
Figure 3:
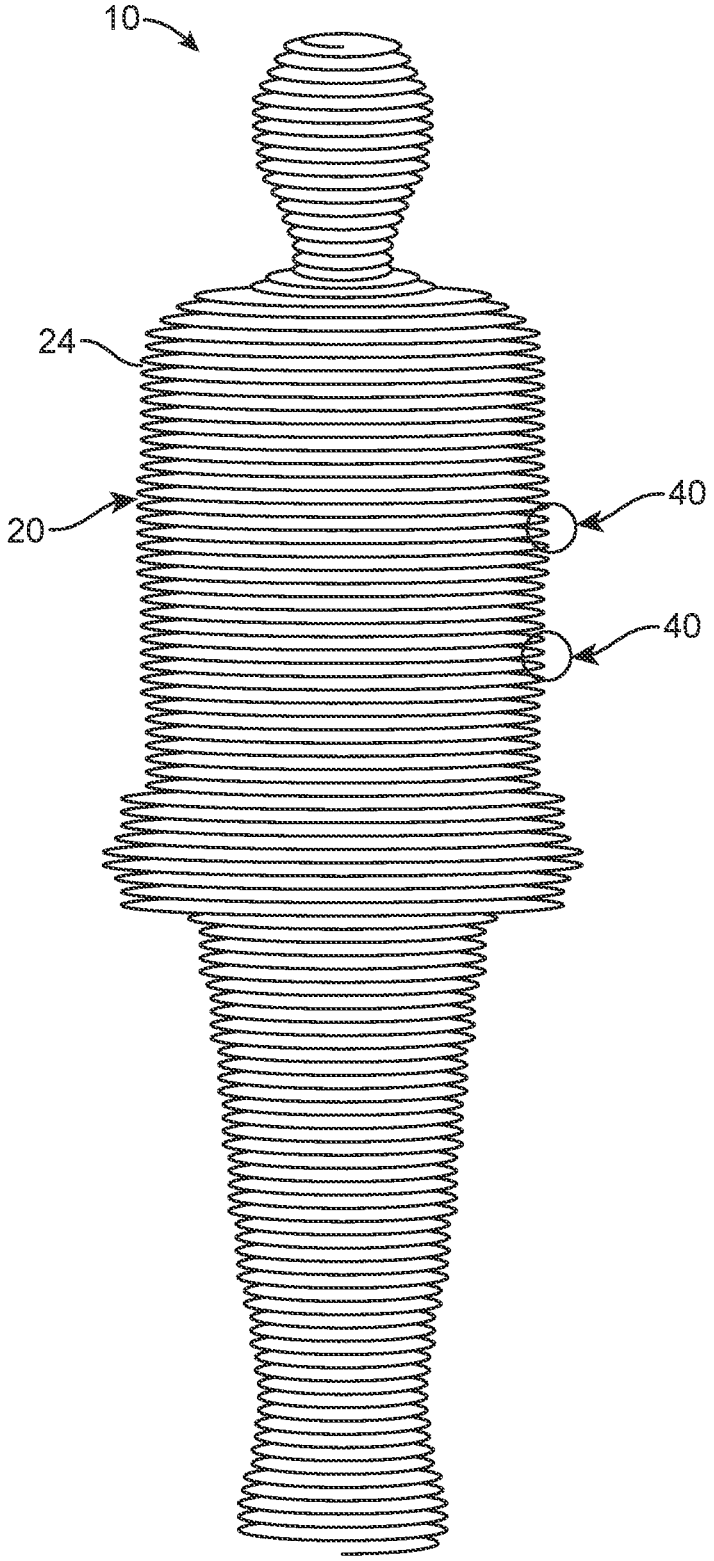
FIG. 3 illustrates an isometric view of a second figurine of figurine assembly 20 in the form of a humanoid figure in accordance to an embodiment of the present invention.
Figure 4:
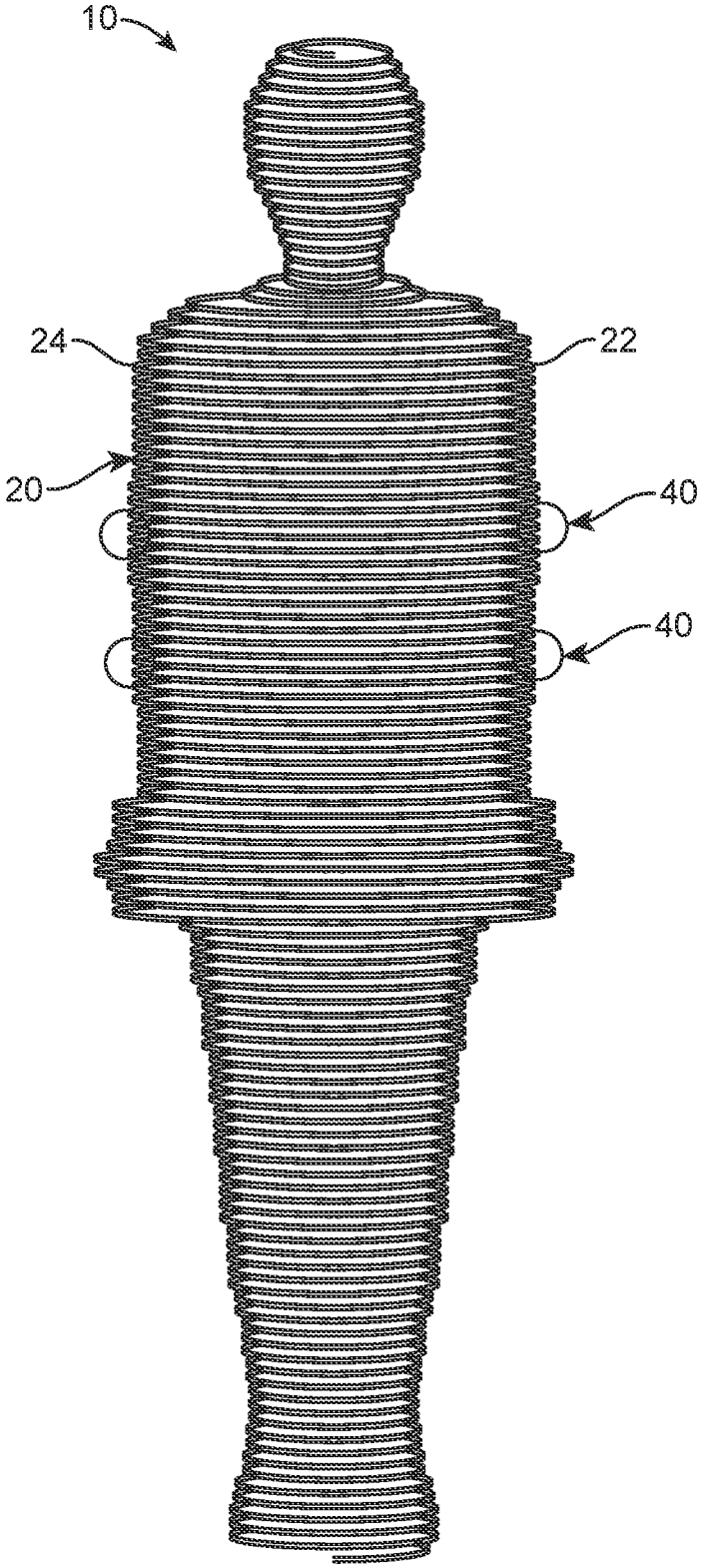
FIG. 4 is a representation of an isometric view of a single unified structure formed by the joining of the first and second figurines of figure assembly 20 in accordance to an embodiment of the present invention.
Figure 5:
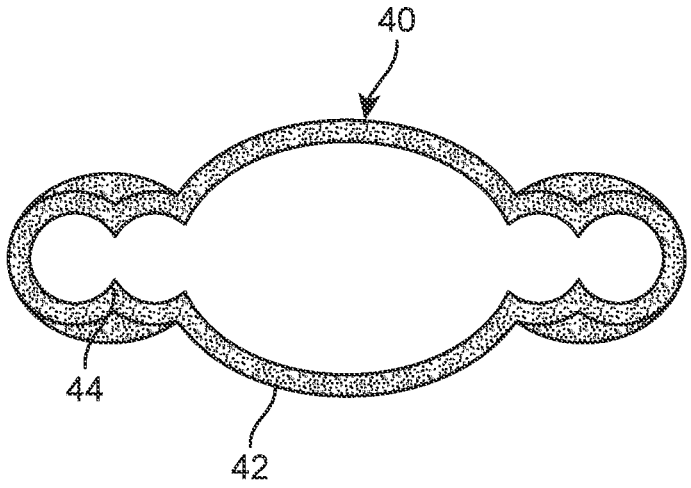
FIG. 5 shows a top view of crimping assembly 40 in accordance to an embodiment of the present invention.
Figure 6:
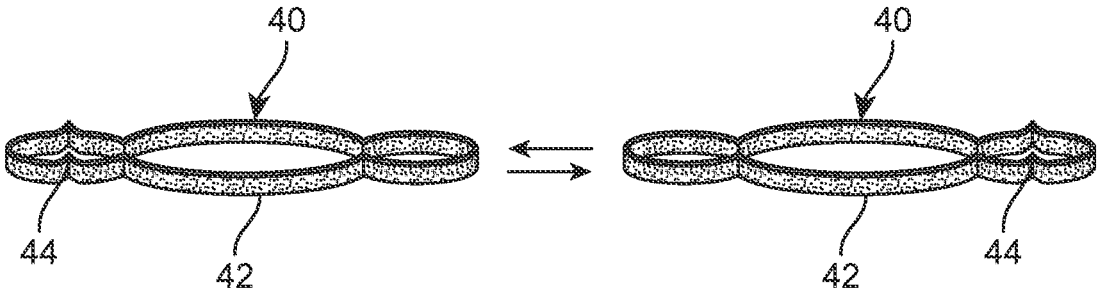
FIG. 6 illustrates a perspective view of crimping assembly 40 showing one crimping layer being joined with another in accordance to an embodiment of the present invention.
Figure 7:
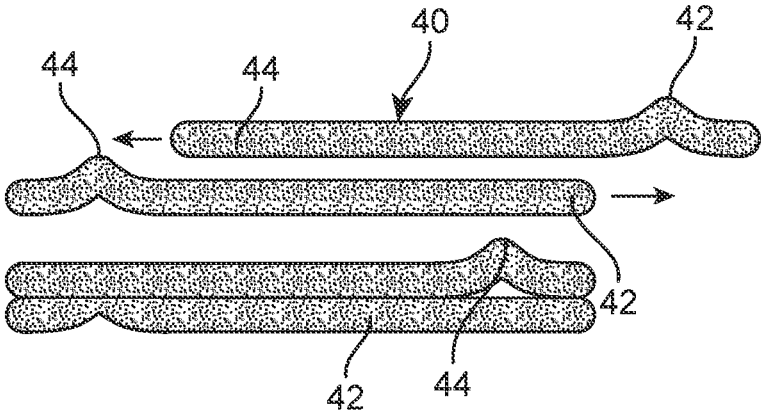
FIG. 7 represents a side view of crimping layer 40 showing stacked crimping layers in accordance to an embodiment of the present invention.

Crimping assembly 40 includes a crimping layer 42 having an indent 44. The crimping assembly 40 may be effectively observed in FIGS. 5-7 of the provided drawings. In the present embodiment, the crimping assembly 40 is provided as being an integral structure of each of the first and second figurine coils 22 and 24. As observed in the drawings, each of the first and second figuring coils 22 and 24 is provided with crimping assemblies 40. At least two crimping layers 42 are implemented onto the first and second coils 22 and 24. Two crimping layers may be located on the right arm of the first figurine coil 22 on an upper arm layer and the same on a lower arm layer. Additionally, two crimping layers may be located on the left arm of the second figurine coil 24 on an upper arm layer and the same on a lower arm layer. The crimping layers include indent 44 which are structural indentations in the material of the coils 22 and 24 toward the inside of the body and being bent slight upward. When each of the figurine coils 22 and 24 are interfitted, a crimping layer 42 of the first figurine coil 22 slides over the crimped layer 42 and the top crimping layer is then compressed and pops over the indent 44. As a result, the top crimping layer nests over the bottom crimped layer. For illustrational purposes, the related figures show the crimping layers 42 drawn as rings. However, it should be understood that the structing of the crimping layers 42 are implemented onto the coil spiral structure of each of the first and second figurine coils 22 and 24. Further, it should be understood that other embodiments may feature more than two crimping layers 42 being provided for each of the figurines.

Referring now to FIG. 9, it can be observed another embodiment of a system for removably interlocking at least two independent figurines 100 which basically includes a support assembly 120 and a ovoid assembly 140.

Support assembly 120 includes at least two of rod 122 which may be made of a metal material. It can be observed in the figure, that rod 122 is a substantially curved rod that is morphed into a predetermined shape. The present embodiment depicts a substantially curved rod that supports a humanoid shape. However, other embodiments of morphed rods may be used depending on the shape that the figurine will take. Furthermore, curved rod may include attachment members along a lateral side that will be used to receive ovoid assembly 140. These attachment members may include attachment means such as magnets, adhesives, snap buttons, crimping mechanism, and the like. Ovoid assembly 140 includes a plurality of circular members 142 that each have a predetermined shape. As observed in the figures, circular members 142 are ovoid structures that when stacked over each other, form a humanoid figure. Circular members 142 are each coupled to the rod 122 along the same lateral side. Each of the circular members 142 has a unique shape that supports the overall humanoid shape of the unified structure. It should be understood that each of the rod 122 and the circular members 142 may be formed into other predetermined shapes to support other variations of unified figurines such as animals, and other educational models.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for removably interlocking at least two independent figurines, comprising:

a) a figurine assembly including at least two figurine coils, wherein each of said figurine coils have a continuous spiral shape with spacing in between, where each of said two figurine coils have a flexible structure; and b) a crimping assembly including a plurality of crimping layers integral to the figurine coils, wherein each of said figurine coils include at least two crimping layers, wherein said crimping layers include an indent in a material which extends towards an inner portion of the figurine coils, said indents having an upward bend, wherein each of the figurine coils are interfitted with each other and such that each of the crimping layers of each of the figurine coils are engaged and a single unified structure is formed.

2. The system for removably interlocking at least two independent figurines of claim 1 wherein each of said figurine coils have a humanoid shape.

3. The system for removably interlocking at least two independent figurines of claim 1 wherein said figurine coils include an enclosure at a top end.

4. The system for removably interlocking at least two independent figurines of claim 3 wherein said enclosure receives a chain.

5. The system for removably interlocking at least two independent figurines of claim 1 wherein said at least two crimping layers include a top layer and a bottom layer.

6. The system for removably interlocking at least two independent figurines of claim 1 wherein the crimping layers are slidable engaged.

7. The system for removably interlocking at least two independent figurines of claim 1 wherein a top crimped layer is compressed and pops over a bottom crimped layer.

8. The system for removably interlocking at least two independent figurines of claim 1 wherein said single unified structure has a humanoid shape.

9. The system for removably interlocking at least two independent figurines of claim 1 wherein said indents are triangular in shape.

10. A system for removably interlocking at least two independent figurines, consisting of:

a) a figurine assembly including a first and second figurine coil, wherein each of said first and second figurine coils have a continuous spiral shape with spacing in between, where each of said first and second figurine coils have a flexible structure, said first and second figurine coil having a top end with an enclosure which receives a chain thereon, wherein said chain is a looped chain structure; and b) a crimping assembly including a top crimping layer and a bottom crimping layer located on each of the first and second figurine coils in, wherein each of top and bottom crimping layers include an indent in a material which extends towards an inner portion, said indents having a triangular shape with an upward bend, wherein the first and second figurine coils are slidably interfitted with each other such that each of the top and bottom crimping layers of each of the figurine coils are engaged and a single unified structure is formed, wherein said top crimped layer is compressed and pops over said bottom crimped layer.

11. A system for removably interlocking at least two independent figurines, consisting of:

a) a support assembly including two rods each having a substantially curved shape, wherein said two rods each include attachment members along a lateral side; and b) an ovoid assembly including a plurality of circular members each having a unique ovoid shape which supports a humanoid configuration, wherein each of said plurality of circular members are mounted to each of the two rods to form two independent humanoid figurines, wherein each of the two independent humanoid figurines are interfitted with each other to form a single unified humanoid structure.

* * * * *